US012305886B2

(12) United States Patent
Long

(10) Patent No.: US 12,305,886 B2
(45) Date of Patent: May 20, 2025

(54) HEATING SYSTEMS WITH UNHOUSED CENTRIFUGAL FAN AND WRAPAROUND HEAT EXCHANGER

(71) Applicant: Rheem Manufacturing Company, Atlanta, GA (US)

(72) Inventor: Robert L. Long, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 149 days.

(21) Appl. No.: 17/120,866

(22) Filed: Dec. 14, 2020

(65) Prior Publication Data

US 2022/0186979 A1 Jun. 16, 2022

(51) Int. Cl.
*F24H 3/04* (2022.01)

(52) U.S. Cl.
CPC ..... *F24H 3/04* (2013.01)

(58) Field of Classification Search
CPC ..... F24F 1/0047; F24F 1/0068; F24H 3/04
See application file for complete search history.

(56) References Cited

U.S. PATENT DOCUMENTS 3,605,717 A * 9/1971 Sauer ..... F24C 15/322 126/91 A
4,484,561 A * 11/1984 Baggott ..... F28F 1/02 126/91 A
4,648,377 A * 3/1987 Van Camp ..... F24C 15/322 126/91 A
5,165,889 A * 11/1992 Baggott ..... F24C 15/322 126/91 A
5,255,969 A 10/1993 Cox et al.
5,678,417 A * 10/1997 Nigo ..... F24F 1/0057 236/44 R
5,915,372 A * 6/1999 Wiedemann ..... F24C 15/322 126/91 A
6,311,685 B1 * 11/2001 Bassoli ..... F24C 15/322 126/91 A
6,346,750 B1 * 2/2002 Jiang ..... C09J 9/02 257/781

(Continued)

FOREIGN PATENT DOCUMENTS

JP 2013194961 A * 9/2013 ..... F24F 1/0007
RU 2578501 C1 3/2016

(Continued)

OTHER PUBLICATIONS

Google Patents, Machine translation of WO-2013136992-A1, 2022 (Year: 2022).*

(Continued)

*Primary Examiner* — Edelmira Bosques
*Assistant Examiner* — Deepak A Deean
(74) *Attorney, Agent, or Firm* — Eversheds Sutherland (US) LLP

(57) ABSTRACT

A heating system with wraparound heat exchanger is disclosed. The system includes a centrifugal fan that expels air radially into a plenum space. A heat exchanger tube is placed in the plenum space, thereby heating the air in the plenum space before it exits an assembly cabinet. The heat exchanger tube can have various configurations, including non-horizontal configurations so as to allow condensate to drain from the heat exchanger tubes.

19 Claims, 6 Drawing Sheets

(56) References Cited

U.S. PATENT DOCUMENTS 6,470,699 B1 * 10/2002 Okuda ..... F24F 1/0007 62/DIG. 16
6,481,237 B2 * 11/2002 Kim ..... F24F 1/0011 62/426
7,017,571 B2 * 3/2006 Smits ..... F24C 15/322 99/474
7,497,246 B2 * 3/2009 Sakashita ..... F24F 13/20 165/53
7,757,749 B2 * 7/2010 Sakashita ..... F24F 13/222 165/53
7,971,451 B2 * 7/2011 Yabu ..... F24F 1/0047 62/426
8,006,512 B2 * 8/2011 Sanagi ..... F24F 1/0047 62/426
8,015,832 B2 * 9/2011 Setoguchi ..... F24F 1/0068 62/93
8,689,577 B2 * 4/2014 Fukushima ..... F24F 1/0068 261/106
9,372,005 B2 * 6/2016 Raghavan ..... F28F 13/08
10,767,874 B2 * 9/2020 Yamasari ..... F04D 29/162
10,976,061 B2 * 4/2021 Kim ..... F24F 1/0033
11,131,479 B2 * 9/2021 Miyata ..... F24F 13/20
11,162,691 B2 * 11/2021 Nakamoto ..... F24F 1/0067
2001/0037874 A1 * 11/2001 Hata ..... F24F 1/0022 165/53
2002/0152760 A1 * 10/2002 Okuda ..... F24F 13/20 62/426
2003/0164096 A1 * 9/2003 Gruhbaum ..... F24C 15/322 99/476
2005/0161209 A1 * 7/2005 Havard, Jr. ..... F24H 3/087 165/177
2005/0163614 A1 7/2005 Chapman
2008/0034775 A1 * 2/2008 Choi ..... F24F 1/0014 62/259.1
2008/0047281 A1 * 2/2008 Fukushima ..... F24F 1/0063 62/78
2009/0013715 A1 * 1/2009 Setoguchi ..... F24F 1/0057 251/129.01
2009/0211284 A1 * 8/2009 Yabu ..... F24F 13/28 62/515
2011/0126917 A1 * 6/2011 Nakata ..... F24F 1/0063 137/268
2014/0150769 A1 * 6/2014 Raghavan ..... F28F 1/006 126/91 A
2016/0033161 A1 * 2/2016 Koyanagi ..... F24F 1/0068 312/236
2016/0102872 A1 * 4/2016 Nakamoto ..... F24F 1/0063 165/122
2018/0031274 A1 * 2/2018 Wilson ..... F28F 1/24
2019/0017753 A1 * 1/2019 Plummer ..... F28F 1/06
2022/0128245 A1 * 4/2022 Murakami ..... F24F 1/0323

FOREIGN PATENT DOCUMENTS

WO WO-2013136992 A1 * 9/2013 ..... F24F 1/0007
WO 2014148793 A1 9/2014
WO 2016178521 A1 10/2016
WO 2018151493 A1 8/2018
WO WO-2018216392 A1 * 11/2018 ..... F24F 1/0011

OTHER PUBLICATIONS

International Search Report and Written Opinion for PCT Application No. PCT/US2021/063002 mailed Mar. 31, 2022.

* cited by examiner

HEATING SYSTEMS WITH UNHOUSED CENTRIFUGAL FAN AND WRAPAROUND HEAT EXCHANGER

FIELD OF THE DISCLOSURE

Examples of the present disclosure relate generally to heating systems and, more specifically, to heating systems including a centrifugal fan and a wraparound heat exchanger.

BACKGROUND

Conventional forced air heating systems include a fan unit that forces air across one or more heating tubes of a heat exchanger. The fan unit is typically positioned at a first location within a system and the heating tubes are positioned at a second location downstream from the fan. These systems have a number of disadvantages that can lead to decreased efficiency. For one, the fans used in most systems include a curved blower that has a single air outlet that supplies the air flow across heating tubes. Because this single air outlet supplies the air flow, the velocity of the air exiting the blower must be substantially high so as to provide sufficient flow across the downstream heating tubes, thereby increasing the overall power consumption of the heating system. Additionally, a conduit is provided between the curved blower and the heating tubes to channel the air across the heating tubes. The space required to provide this air channel can increase the footprint of the overall heating unit.

Another disadvantage of prior systems includes the non-uniform distribution of the air flow across the heating tubes. For example, since the blower and the heating tubes are separated from each other in prior designs, it is more difficult to channel the air flow consistently across the entirety of the heating tubes. This can lead to hot zones and cool zones across the heat exchanger, decreasing the overall heating efficiency of the system. What is needed, therefore, is an energy efficient system that provides uniform air distribution around the heat exchanger to increase the heating efficiently of the system.

BRIEF SUMMARY

These and other problems can be addressed by the technologies described herein. Examples of the present disclosure relate generally to heating systems and, more specifically, to heating systems including a centrifugal fan and a wraparound heat exchanger.

The present disclosure provides a heat exchanger assembly. The heat exchanger assembly can include one or more heat exchanger tubes and a centrifugal fan. The heat exchanger tube(s) can include a first section, a second section, and a curved section between the first section and the second section (i.e., the curved section can fluidly connect the first section and the second section). The centrifugal fan can be positioned between the first section and the second section and can pull in air from a fan inlet and disperse air across the first section, the second section, and the curved section.

The centrifugal fan can be a plenum fan and the heat exchanger tube(s) can be placed within a plenum space of the plenum fan. The plenum fan can be a direct drive single inlet unhoused plenum fan such that the heat exchanger tube(s) can be placed adjacent the fan.

In some examples, the heat exchanger assembly can be housed within an outer cabinet. The cabinet can include at least one cabinet inlet positioned near the fan inlet, and the cabinet can include one or more cabinet outlets.

The shapes and geometries of the heat exchanger tube, or the sections of the heat exchanger tube, can be altered for various design attributes. For example, the first section and the second section can be parallel with respect to one another. The heat exchanger tube(s) can also be positioned so as to reduce the occurrence of condensation within the tube. The first section and the second section can have a non-zero angle with respect to horizontal when viewed from a side of the heat exchanger tube.

The first section can have a first angle with respect to horizontal when viewed from a side of the heat exchanger tube, and the second section can have a second angle with respect to horizontal when viewed from a side of the heat exchanger tube. The second angle can be a different angle than the first angle. The first angle can be 0°. The second angle can be a decline angle, wherein a first position of the second section proximate the curved section is higher with respect to horizontal than a second portion of the second section proximate an ingress portion of the heat exchanger tube.

The first section and the second section can be substantially straight. A radius of curvature of the curved section can be less than 180°, i.e., the heat exchanger tube(s) can be wider at their ingress/egress portions that at the curved section.

A center of the centrifugal fan can be positioned at a first distance from the first section and at a second distance from the second section, wherein the first distance is a different distance than the second distance. By altering the positioning of the centrifugal fan, the fan can be customized to avoid cool/hot spots within the plenum space.

Another aspect of the present disclosure provides a heating system. The heating system can include centrifugal fan including a fan inlet. The heating system can include a heat exchanger tube positioned at least partially around the centrifugal fan. The heating system can include a cabinet that contains the centrifugal fan and at least a portion of the heat exchanger tube. The cabinet can include an air inlet positioned proximate the fan inlet and an air outlet. The centrifugal fan can disperse air radially from a center of the centrifugal fan and across at least a portion of the heat exchanger tube.

The heat exchanger tube can include a first section, a second section, and a curved section disposed between the first section and the second section, as described above for the heat exchanger assembly. The first section and the second section can be parallel with respect to one another. The first section and the second section can have a non-zero angle with respect to horizontal when viewed from a side of the heat exchanger tube.

The first section can have a first angle with respect to horizontal when viewed from a side of the heat exchanger tube, and the second section can have a second angle with respect to horizontal when viewed from a side of the heat exchanger tube, the second angle being a different angle than the first angle. The second angle can be a decline angle, wherein a first position of the second section proximate the curved section is higher with respect to horizontal than a second portion of the second section proximate an ingress portion of the heat exchanger tube.

The centrifugal fan can be a plenum fan. The cabinet can define a plenum space around the centrifugal fan, and the heat exchanger tube can be positioned within the plenum space.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner. In the drawings.

DETAILED DESCRIPTION

Forced air heating systems typically include a heating element having one or more heating tubes and a fan to force air across the heating element. In prior designs, these two devices were separated a certain distance. A fan at one location in the system provides air flow through ductwork or a cabinet such that the air contacts the heat exchanger before exiting the system to heat the building. Prior designs had a number of disadvantages that increased the power consumption and decreased the heating efficiency of the system. For one, separating the fan from the heating element can decrease the efficiency of the system. A great deal of air flow must be provided through the system to ensure enough air comes in contact with the distally placed heat exchanger tubes. Even with sufficient air flow, not all air flowing through the system may interact evenly with the heating element, as certain areas will have hot spots while other areas will have cool spots.

Another inefficiency is found in the fan itself. Typical existing systems utilize a curved blower that has a single air outlet. The air exiting the blower must be at a high velocity so as to provide sufficient flow across the downstream heating tubes, thereby increasing the overall power consumption of the heating system. More recently, manufacturers began incorporating plenum fans in heating system designs. Plenum fans do not have a singular outlet, but instead provide radial air flow to pressurize a space around the fan. Because of this, the air flow provided by the fan is slower, thereby lowering power consumption of the system. However, prior plenum-system designs had a similar drawbacks when it comes to heating efficiency. These systems also separate the fan from the heating element. Since air must still flow through a cabinet or ductwork to a downstream heating element, certain areas will have hot spots while other areas will have cool spots, just as in the blower system.

The present systems provide a solution to both the power and the heating efficiency issues described above. The design includes an unhoused centrifugal fan to pressurize a plenum space. Instead of separating the heating element from the fan, like in prior designs, the systems include one or more heating tubes placed directly in the plenum space. A large radius bend in the heating tube(s) can enable even air flow and decrease the occurrence of hot spots in the air flow. After the air is evenly heated in the plenum space, the heated air can exit the system at an outlet and travel to heat the building. Various heating systems including a centrifugal fan and a wraparound heat exchanger are disclosed, and example systems will now be described with reference to the accompanying figures.

Figure 1:
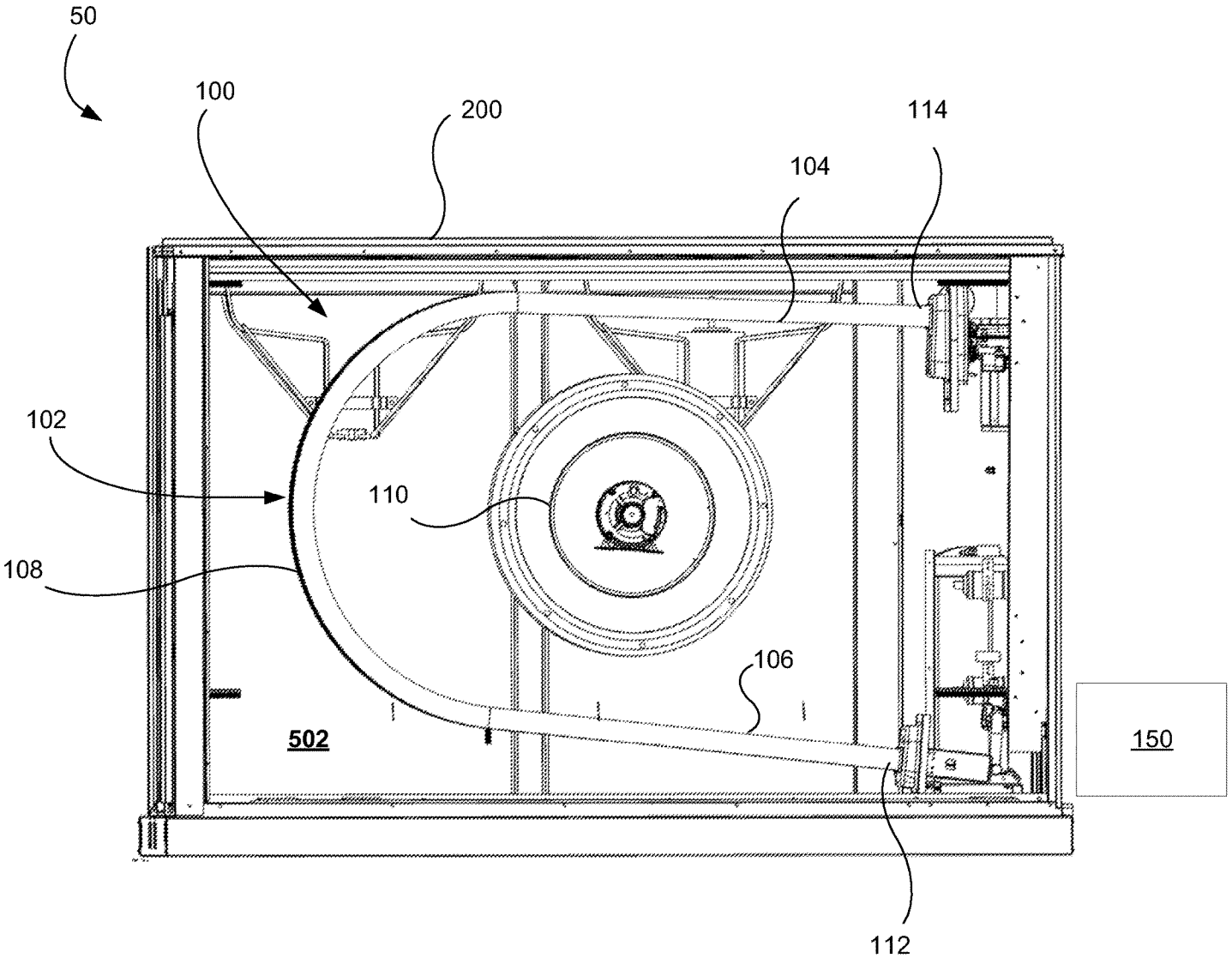
FIG. 1 is a side view of a heat exchanger assembly within a heating cabinet, according to the present disclosure.

FIG. 1 is a side view of a heat exchanger assembly 100. A heat exchanger assembly 100 can include one or more heat exchanger tubes 102. When reference is made herein to a singular heat exchanger tube, it will be understood that the reference can refer to a plurality of heat exchanger tubes. The heat exchanger tube 102 can include a first section 104, a second section 106, and a curved section 108 located between the first section 104 and the second section 106. The first section 104 and second section 106 can be straight sections of the heat exchanger tube 102. However, as will be described in greater detail below with reference to FIGS. 5A-5D, other shapes and configurations for the heat exchanger tube 102 are contemplated.

While the heat exchanger assembly 100 is described herein as passing heated combustion gases through the heat exchanger tube 102, it is contemplated that the heat exchanger tube 102 can be configured to pass refrigerant, water, or other fluids for exchanging heat to another fluid passing over the exterior of the heat exchanger tube 102. Further, while the heat exchanger assembly 100 is primarily described herein as providing heat (i.e., performing the functionality of a condenser), it is contemplated that the heat exchanger assembly 100 can provide a cooling effect (i.e., performing the functionality of an evaporator). Further still, at certain points within this disclosure, the heat exchanger assembly 100 is described as being included in a combined HVAC unit (e.g., HVAC unit 75) including both heating and air-conditioning elements. It is contemplated, however, that the heat exchanger assembly 100 can be a standalone heat exchanger. For example, the heat exchanger assembly 100 can be a standalone evaporator and/or a standalone condenser.

The heat exchanger tube 102 can be placed around or at least partially around a centrifugal fan 110. The centrifugal fan 110 can be a plenum fan, backward inclined plug fan, or other direct drive or belt drive radial fan. One benefit of a centrifugal fan is that it requires less air velocity and, therefore, draws less power than a blower to provide air flow. Air drawn into the centrifugal fan can be expelled radially into a plenum space 502 within a heating cabinet 200, thereby pressurizing the plenum space 502. Because the centrifugal fan 110 can be unhoused, the heat exchanger tube 102 can be placed in the plenum space 502 directly adjacent the fan so that the pressurized air can be evenly heated before the air exits the heat exchanger assembly 100. In other words, the plenum space 502 can be defined as the space between the centrifugal fan 110 and the heating cabinet 200 housing the centrifugal fan 110 and the heat exchanger tube 102, and the tube can be placed within that space.

At one end of the heat exchanger tube 102 can be an ingress portion 112 of the tube. The ingress portion 112 can be positioned proximate a burner assembly 150, for example a gas burner that provides heated combustion gases to be passed through the heat exchanger tube(s) 102. Heated air can enter the ingress portion 112 of the heat exchanger tube 102 and proceed to an egress portion 114 of the tube. The combustion gases can exit an outlet of each heat exchanger tube 102 and flow through an opening near the egress portion 114 of the tube. Although FIG. 1 depicts the ingress portion 112, burner assembly 150, and second section 106 being positioned at a bottom of the heat exchanger assembly 100, and the egress portion 114 and first section 104 being positioned at a top, this is merely illustrative, and the groups of features can be repositioned such that either is on top or bottom of the heat exchanger assembly 100. For example, the ingress portion 112 can be positioned at the top in FIG. 1 and proximate a burner assembly 150 also positioned at the top.

The heat exchanger assembly 100 can be positioned within an outer heating cabinet 200 that defines the plenum space 502. As will be described herein, the heating cabinet 200 can include a cabinet air outlet 206 and cabinet air inlet 204. When reference is made herein to the heat exchanger assembly (e.g., heat exchanger assembly 100), the term can be understood to include the heat exchanger tube 102 and the centrifugal fan 110. When reference is made herein to the "heating system" as a whole, the term heating system can be understood to mean the heat exchanger assembly 100 packaged into a unit, for example via the heating cabinet 200. The "heating system" will be referred to hereinafter as heating system 50. Further still, and as will be described below, the system as a whole can include an outer housing 250 that can include the heating system 50, an upstream section 302, and a lower section 306. Lower section 306 can house a condensing unit, which can include a condenser coil, outdoor fans, and refrigerant compressors (air for the gas heat exchanger does not necessarily flow through lower section 306 shown in FIG. 1).

Figure 2:
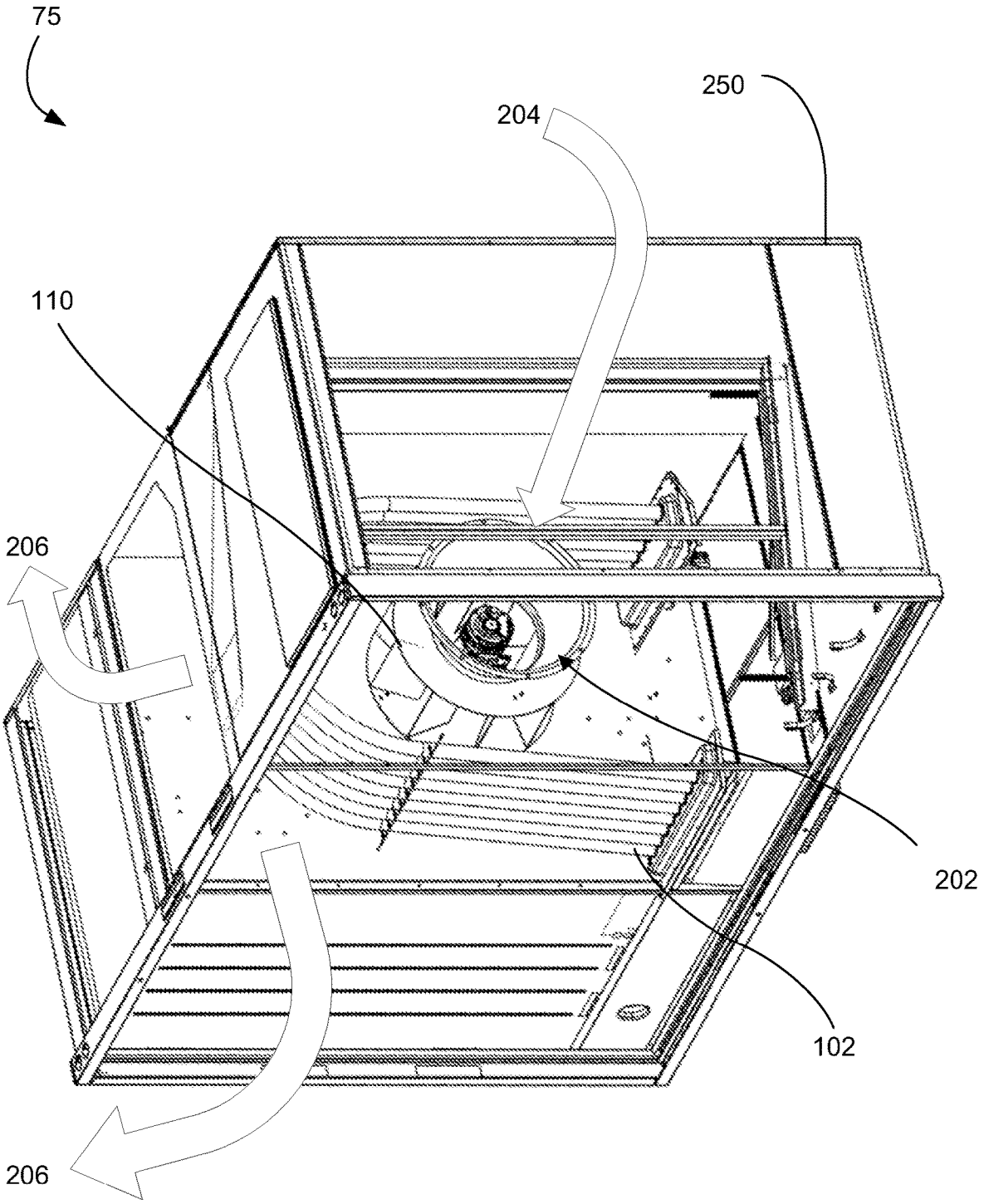
FIG. 2 is a perspective view of a heat exchanger assembly within an outer housing, according to the present disclosure.

FIG. 2 is a perspective view of a heat exchanger assembly 100. The centrifugal fan 110 can have a fan inlet 202 positioned to draw air into the centrifugal fan 110. The fan inlet 202 can have a conical shape with a circular opening along a plane. The fan inlet 202 can be positioned at the cabinet inlet 204 of the cabinet. The heating cabinet 200 can include a plate (not shown in view) that covers the cabinet inlet 204, and the plate can have a hole sized to correspond to the fan inlet 202 so that the air is directed into the centrifugal fan 110. The fan inlet 202 can be positioned at any location within the heating cabinet 200 such that air can travel into the inlet from an upstream duct system or cabinet. The heating cabinet 200 can also include a cabinet outlet 206. The air leaving the heating cabinet 200 at the cabinet outlet 206 can be heated (e.g., by the heat exchanger tube 102), and ductwork can direct the heated air to various locations of the building being heated.

Figure 3:
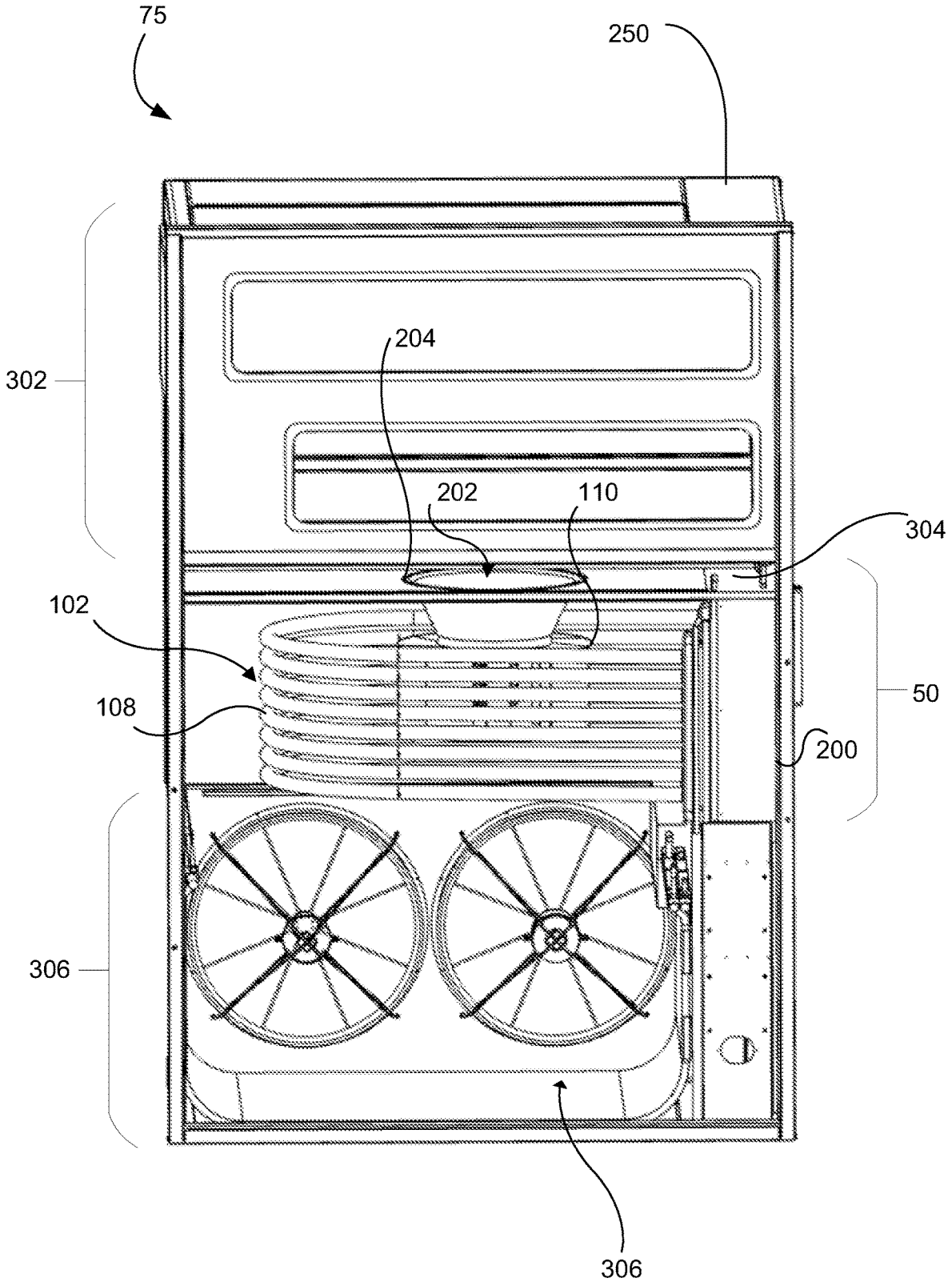
FIG. 3 is a side view of a heat exchanger assembly within an outer housing, according to the present disclosure.

FIG. 3 is a side view of a heat exchanger assembly 100 within an outer housing 250. In addition to the heating cabinet 200 that encloses the centrifugal fan 110 and the heat exchanger tube(s) 102, the outer housing 250 can include an upstream section 302 and a condensing unit 306 comprised of refrigerant compressors, condenser coils, outdoor fans section, and the like, which can be implemented to reject the heat extracted by the evaporator coil in upstream section 302. FIG. 3 provides a view of an example location of a fan inlet 202 with respect to the heat exchanger tubes 102 within an outer housing 250. Air can be channeled into the fan inlet 202 from the upstream section 302. The upstream section 302 can be a part of the heating cabinet 200, can be a separate cabinet within the outer housing 250, or can be separate ductwork that provides air to the fan inlet 202. The upstream section 302 can include a filter slot 304 to accept a filter, the filter slot 304 being positioned proximate the cabinet inlet 204.

The upstream section 302 can also include an evaporator coil. As will be appreciated, the heating components of a heating and cooling system can be placed in series after the cooling components of the system. As will be described in greater detail with reference to FIGS. 5A-5D, the heat exchanger assembly 100 can be configured to reduce or eliminate occurrence of condensation within the tubes 102 that may be caused when the system is in cooling mode (for example, when cool, air-conditioned air is flowing across the heat exchanger tube 102 on its way to corresponding ductwork) and/or when the system is in heating mode (for example, when the heat exchanger assembly 100 is providing heat to passing air). When the heating system 50 and the upstream section 302 are combined into one unit, for example within outer housing 250, the entire system can be referred to as the HVAC unit 75.

Figure 4:
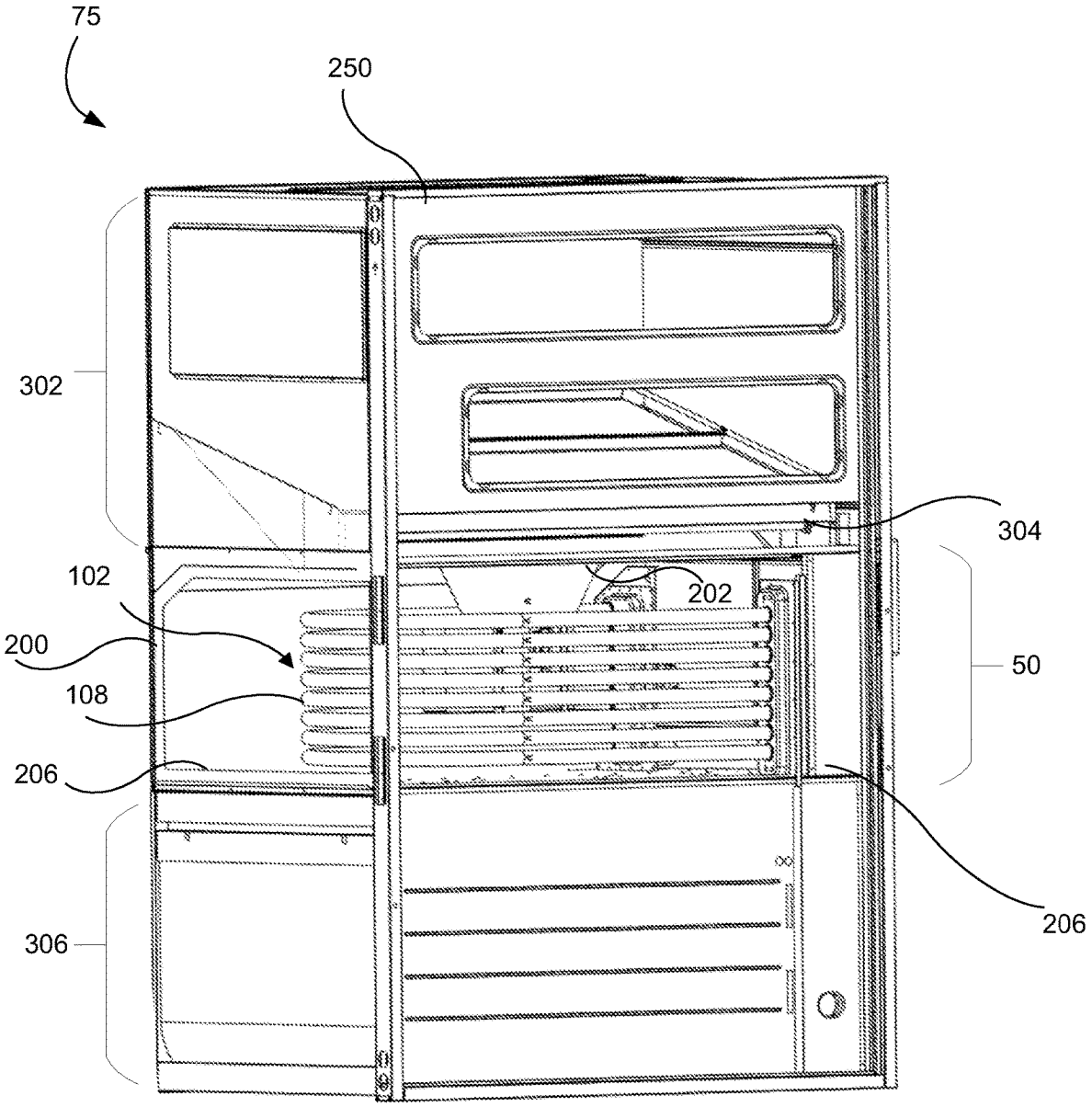
FIG. 4 is a side perspective view of a heat exchanger assembly within an outer housing, according to the present disclosure.

FIG. 4 is a side perspective view of a heat exchanger assembly 100 within an outer housing 250. The view shows how the heating cabinet 200 that houses the centrifugal fan 110 and the heat exchanger tube(s) 102 can include one or more cabinet outlets 206. The system utilizes a centrifugal fan 110 to pressurize a plenum space 502, meaning any face of the heating cabinet 200 can be an outlet, depending on where the outward-flowing ductwork is placed in relation to the cabinet faces. This is variability of cabinet outlet 206 placement is discussed in greater detail with reference to FIGS. 5A-5D.

Figure 5A:
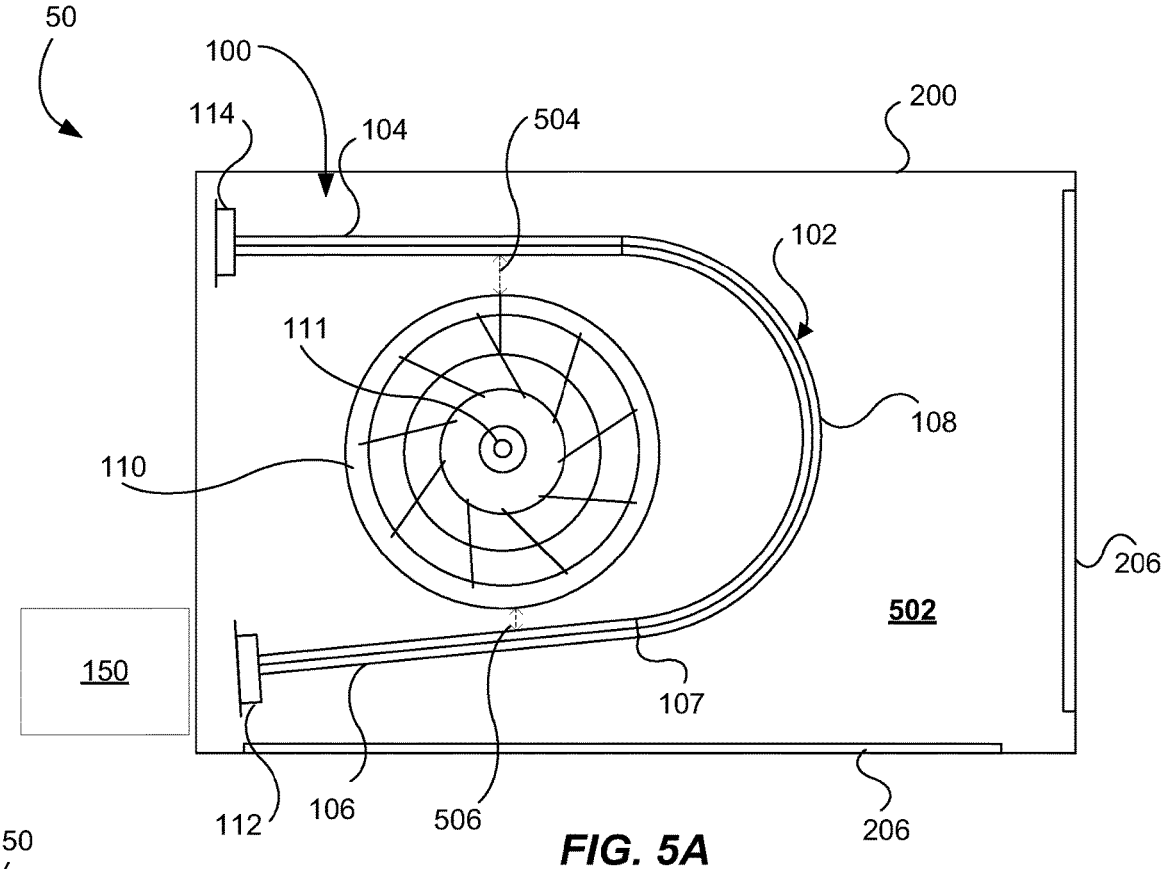
FIGS. 5A-5D are side schematic views of heat exchanger assemblies, according to the present disclosure.

FIGS. 5A-5D are side schematic views of heat exchanger assemblies 100. The different schematics provide various examples of system geometries and configurations. Referring to FIG. 5A, a heat exchanger tube 102 can include a first section 104, a second section 106, and a curved section 108 disposed between the first section 104 and the second section 106. The first section 104 and the second section 106 can be substantially straight sections located at each end of the curved section 108. A radius of curvature of the curved section 108 can be less than 180°, as shown in FIG. 5A. In these examples, the first section 104 and the second section 106 can be positioned in the heating cabinet 200 non-parallel to each other. The less-than-180° curvature can provide a number of advantages. For one, this construct provides a wider opening between the ingress portion 112 and egress portion 114 of the heat exchanger tube 102. This large radius bend can, therefore, facilitate the manufacturability of the heat exchanger assembly 100, making it possible to slide the heat exchanger tube 102 around the centrifugal fan 110 from the side.

Another benefit of the large-radius bend in the heat exchanger tube 102 is the ability to provide a drainage route for condensate in the heat exchanger tube 102. Condensate may accumulate on the inside of the heat exchanger tube 102 in a number of ways. For example, in heating mode, the burner assembly 150 heats combustion gases, and then the heated combustion gases are routed through the heat exchanger tube 102. At the same time, ambient-temperature air can flow across the heat exchanger tube 102. This can cause a cooling of the combustion gases within the heat exchanger tube 102 below the dew point, thereby causing condensation within the tube. Conversely, in cooling mode, heat exchanger tube 102 houses ambient-temperate air, yet cool, air-conditioned air flows across the heat exchanger tube 102 from the upstream air-conditioning unit. In any event, condensation within the heat exchanger tube 102 can cause a decrease in efficiency. To this end, one or more of the first section 104 or second section 106 can be tilted with respect to horizontal so as to provide a drainage route for condensate. In FIG. 5A, for example, the first section 104 has a zero-angle decline with respect to horizontal, while the second section 106 has a non-zero angle decline with respect to horizontal. The second section 106 can have a decline angle, wherein a first position 107 of the second section 106 proximate the curved section 108 is higher with respect to horizontal than a second portion of the second section 106 proximate the ingress portion 112 of the heat exchanger tube 102. This decline angle can enable drainage out of the second section 106.

Figure 5B:
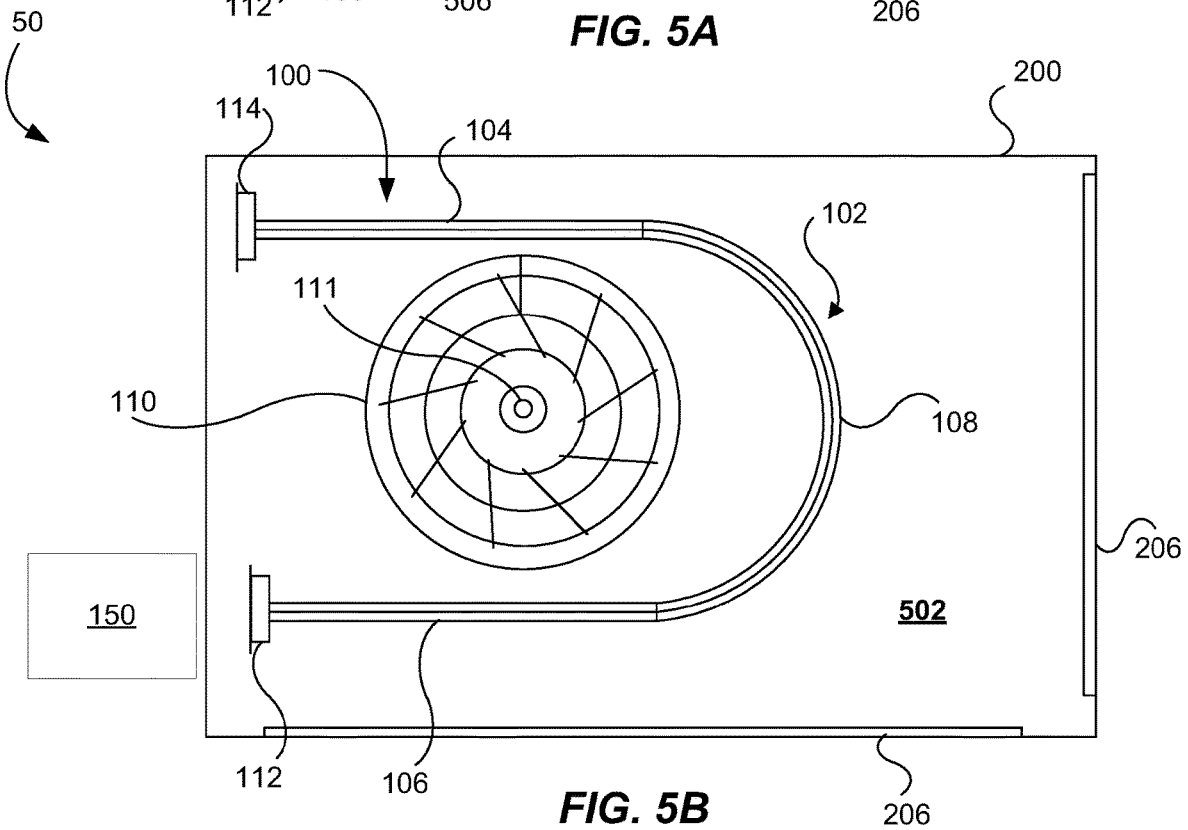
Figure 5C:
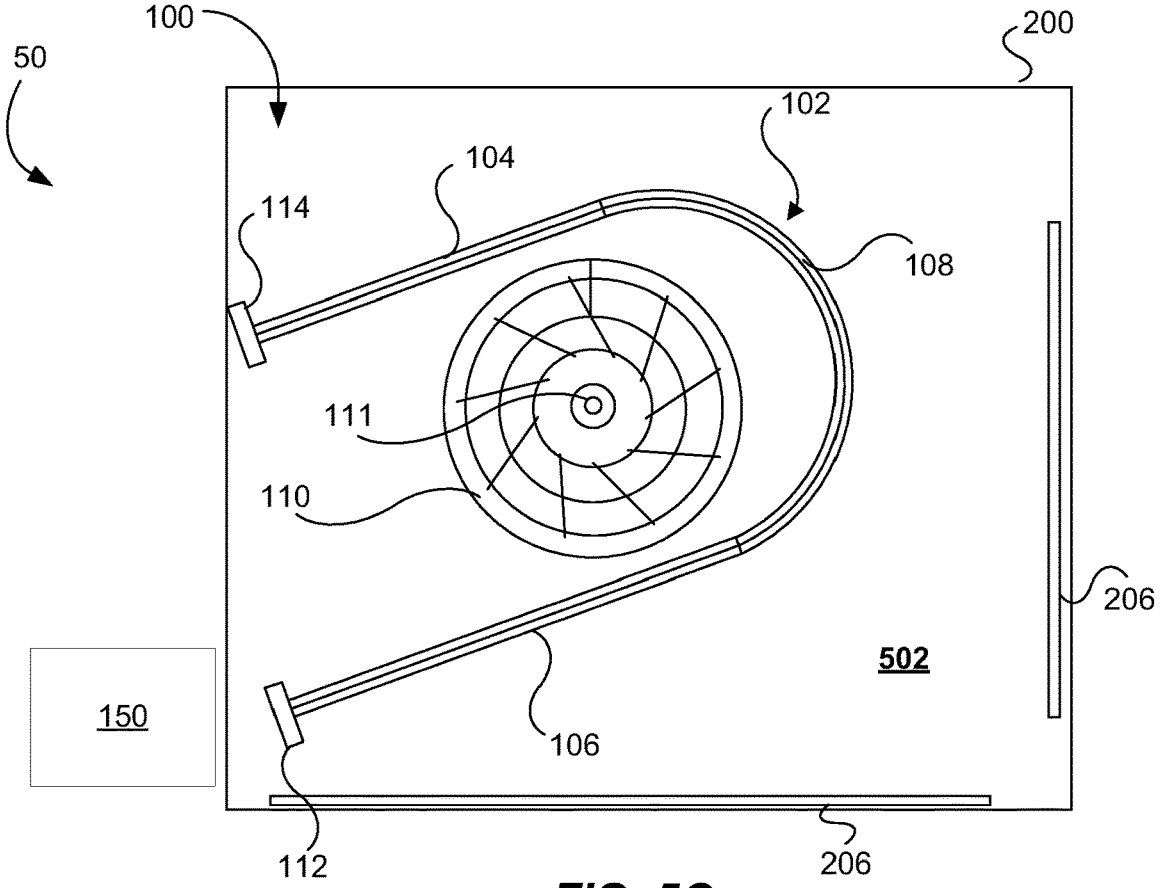

The schematic in FIG. 5B depicts an alternative configuration for the heat exchanger assembly 100. The first section 104 and the second section 106 can be parallel. In these examples, the radius of curvature of the curved section 108 can be substantially 180°. In yet another alternative configuration, as shown in FIG. 5C, first section 104 and the second section 106 can be parallel, but both sections 104, 106 can be tilted with respect to horizontal. In these examples, both the first section 104 and the second section 106 can provide a decline angle (or a non-zero angle with respect to horizontal) to enable condensate to drain from the heat exchanger tube 102.

Figure 5D:
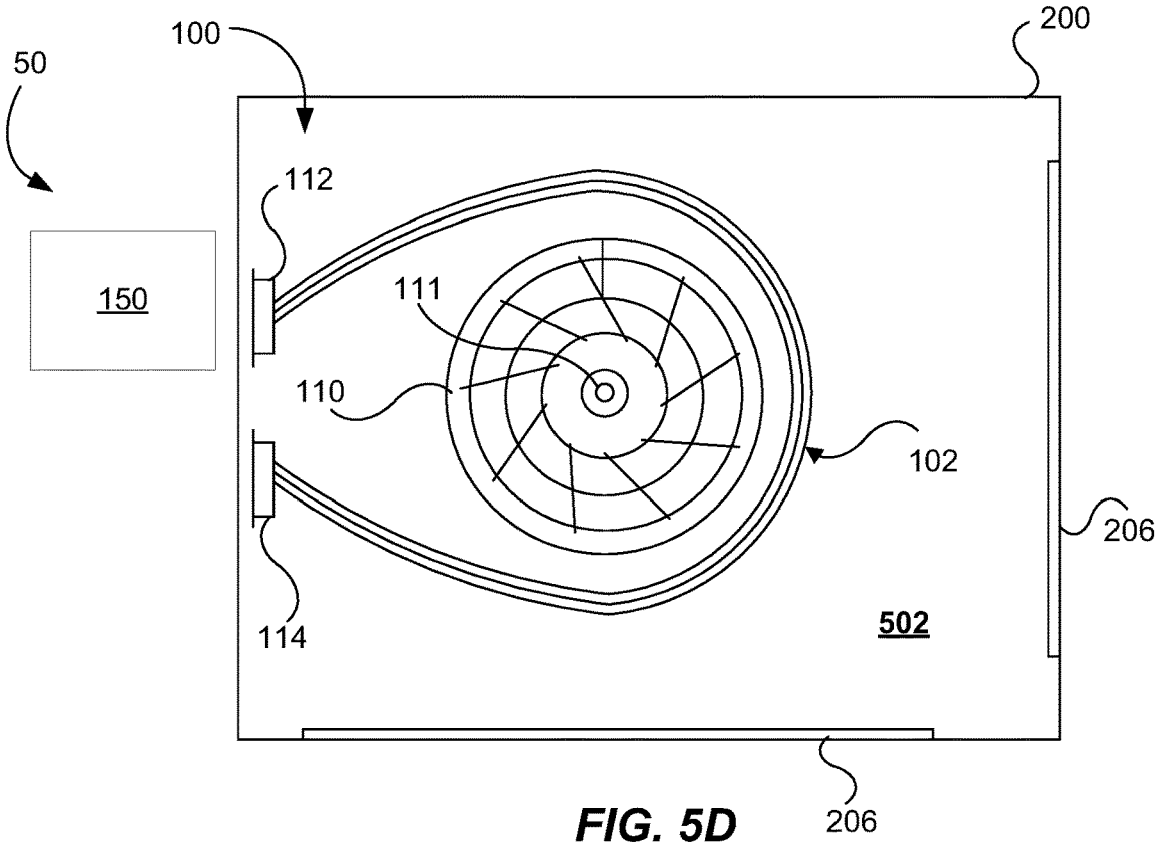

FIG. 5D is a schematic of a heat exchanger assembly 100 without a straight section. The various examples described above include a straight first section 104 and second section 106. However, the present systems are not limited to systems with straight sections on the heat exchanger tube 102. Instead, the heat exchanger tube 102 can have a circular or substantially circular geometry when viewed from the side. Stated otherwise, the heat exchanger tube(s) 102 can be a continuous bend with no distinctive breaks between the ingress portion 112 and the egress portion 114. In these examples, a large portion of the outer radius of the centrifugal fan 110 can be covered by the heat exchanger tube to provide even distribution of heat to the air flowing radially from the centrifugal fan 110.

Referring again to FIG. 5A, a location of the centrifugal fan 110 with respect to the heat exchanger tube 102 can be altered so as to adjust the heat transfer efficiency of the system. For example, a center 111 of the centrifugal fan 110 can positioned at a first distance 504 from the first section 104 and at a second distance 506 from the second section 106. The first distance 504 and the second distance 506 can be adjusted based on a number of factors. The first distance 504 can be greater than the second distance 506, for example, so as to ensure that the centrifugal fan 110 is located closer to the hotter of the sections (e.g., the second section 106 can be hotter if located closest to the burner assembly 150).

The location of the center 111 of the centrifugal fan 110 with respect to the heat exchanger tube 102 can also be altered according to the location of the cabinet outlet 206. As described above, the location of the one or more cabinet outlets 206 can be changed because the centrifugal fan 110 does not have a single air outlet. Any face, or panel, of the heating cabinet 200 can, therefore, be or include a cabinet outlet 206. It is contemplated that the center 111 of the centrifugal fan 110 can be positioned such that it is farther away from the cabinet outlet 206, thereby ensuring a large proportion of the radial airflow exiting the fan interacts with the heat exchanger tube 102 before exiting the heating cabinet 200.

It should also be noted that, as used in the specification and the appended claims, the singular forms "a," "an," and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

While the present disclosure has been described in connection with a plurality of exemplary aspects, as illustrated in the various figures and discussed above, it is understood that other similar aspects can be used, or modifications and additions can be made, to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

What is claimed is:

1. A heat exchanger assembly comprising:

an outer housing comprising an upstream section and a lower section, wherein the upstream section comprises an evaporator, and wherein the lower section comprises a condenser unit;

a burner assembly;

a heat exchanger tube comprising a first section positioned at a first distance from the burner assembly comprising an ingress disposed adjacent to a first side of the heat exchanger assembly, a second section positioned at a second distance from the burner assembly comprising an egress disposed adjacent to the first side of the heat exchanger assembly, and a curved section disposed between the first section and the second section, wherein a first end of the first section connects to a first end of the curved section, wherein a first end of the second section connects to a second end of the curved section, wherein the first section, the second section, and the curved section form a U-shape extending from the ingress to the egress, and wherein the second distance is greater than the first distance; and a centrifugal fan positioned between the first section and the second section and configured to pull in air from a fan inlet and disperse air across the first section, the second section, and the curved section;

wherein the heat exchanger tube loops around the centrifugal fan; and wherein a center portion of the centrifugal fan is positioned at a third distance from the first section and at a fourth distance from the second section, wherein the fourth distance is greater than the third distance.

2. The heat exchanger assembly of claim 1, wherein the centrifugal fan is a plenum fan and the heat exchanger tube is disposed within a plenum space of the plenum fan.

3. The heat exchanger assembly of claim 2, wherein the plenum fan is a direct drive single inlet unhoused plenum fan.

4. The heat exchanger assembly of claim 1, further comprising a cabinet that contains the heat exchanger tube and the centrifugal fan, the cabinet comprising at least one cabinet inlet positioned proximate the fan inlet and one or more cabinet outlets.

5. The heat exchanger assembly of claim 1, wherein the first section and the second section are parallel with respect to one another.

6. The heat exchanger assembly of claim 5, wherein the first section and the second section have a non-zero angle with respect to horizontal when viewed from a side of the heat exchanger tube.

7. The heat exchanger assembly of claim 1, wherein:

the first section has a first angle with respect to horizontal when viewed from a side of the heat exchanger tube; and the second section has a second angle with respect to horizontal when viewed from a side of the heat exchanger tube, the second angle being a different angle than the first angle.

8. The heat exchanger assembly of claim 7, wherein the first angle is 0°.

9. The heat exchanger assembly of claim 7, wherein the second angle is a decline angle, wherein a first portion of the second section proximate the curved section is higher with respect to horizontal than a second portion of the second section proximate an ingress portion of the heat exchanger tube.

10. The heat exchanger assembly of claim 1, wherein the first section and the second section are substantially straight.

11. The heat exchanger assembly of claim 10, wherein the curved section forms an angle of less than 180°.

12. The heat exchanger assembly of claim 1, wherein the curved section forms an angle of less than 180°.

13. A heating system comprising:

a burner assembly;

a centrifugal fan comprising a fan inlet;

a heat exchanger tube positioned at least partially around the centrifugal fan, the heat exchanger tube comprising a first section positioned at a first distance from the burner assembly comprising an ingress disposed adjacent to a first side of the heating system, a second section positioned at a second distance from the burner assembly comprising an egress disposed adjacent to the first side of the heating system, and a curved section disposed between the first section and the second section, wherein a first end of the first section connects to a first end of the curved section, wherein a first end of the second section connects to a second end of the curved section, wherein the first section, the second section, and the curved section form a U-shape extending from the ingress to the egress, and wherein the second distance is greater than the first distance;

wherein a center portion of the centrifugal fan is positioned at a third distance from the first section and at a fourth distance from the second section, wherein the fourth distance is greater than the third distance;

a cabinet that contains the centrifugal fan and at least a portion of the heat exchanger tube, the cabinet comprising an air inlet positioned proximate the fan inlet and an air outlet, wherein the centrifugal fan is configured to disperse air radially from the center portion of the centrifugal fan and across at least a portion of the heat exchanger tube;

wherein a flow path through the heat exchanger tube loops around the centrifugal fan; and an outer housing comprising an upstream section and a lower section, wherein the upstream section comprises an evaporator, and wherein the lower section comprises a condenser unit.

14. The heating system of claim 13, wherein the first section and the second section each extend perpendicular to the first side of the heating system.

15. The heating system of claim 13, wherein the first section and the second section are parallel with respect to one another.

16. The heating system of claim 13, wherein the first section and the second section have a non-zero angle with respect to horizontal when viewed from a side of the heat exchanger tube.

17. The heating system of claim 13, wherein:

the first section has a first angle with respect to horizontal when viewed from a side of the heat exchanger tube; and the second section has a second angle with respect to horizontal when viewed from a side of the heat exchanger tube, the second angle being a different angle than the first angle.

18. The heating system of claim 17, wherein the second angle is a decline angle, wherein a first portion of the second section proximate the curved section is higher with respect to horizontal than a second portion of the second section proximate an ingress portion of the heat exchanger tube.

19. The heating system of claim 13, wherein:

the centrifugal fan is a plenum fan;

the cabinet defines a plenum space around the centrifugal fan; and the heat exchanger tube is disposed within the plenum space.

* * * * *